US007255140B2

(12) United States Patent
Poli

(10) Patent No.: US 7,255,140 B2
(45) Date of Patent: Aug. 14, 2007

(54) FUEL NOZZLE HAVING IMPROVED HOLD-OPEN CLIP

(75) Inventor: E. Leonard Poli, High Ridge, MO (US)

(73) Assignee: M. Carder Industries, Inc., Fenton, MO (US)

( * ) Notice: Subject to any disclaimer, the term of this patent is extended or adjusted under 35 U.S.C. 154(b) by 80 days.

(21) Appl. No.: 11/115,918

(22) Filed: Apr. 27, 2005

(65) Prior Publication Data

US 2006/0243348 A1 Nov. 2, 2006

(51) Int. Cl.
*B65B 1/30* (2006.01)

(52) U.S. Cl. ..... 141/218; 141/206; 141/392

(58) Field of Classification Search ..... 141/206, 141/208, 218, 392; 251/89, 152
See application file for complete search history.

(56) References Cited

U.S. PATENT DOCUMENTS 3,273,609 A 9/1966 Carder et al.
3,635,415 A 1/1972 Boudot et al.
3,653,415 A * 4/1972 Boudot et al. ..... 141/208
3,757,834 A 9/1973 Carder
3,817,285 A 6/1974 Wilder et al.
3,823,752 A 7/1974 Lasater et al.
4,593,729 A 6/1986 Tamra
5,067,533 A 11/1991 Carder et al.
5,832,970 A 11/1998 Carow
6,585,014 B1 7/2003 Fink, Jr.
6,698,471 B1 3/2004 Carmack

* cited by examiner

*Primary Examiner*—Timothy L. Maust
(74) *Attorney, Agent, or Firm*—Polster, Lieder, Woodruff & Lucchesi, L.C.

(57) ABSTRACT

An automatic shut-off nozzle having an operating lever pivoted at its forward end to a plunger, a clip pivoted to the lever, the clip engaging a holding structure and holding the lever open when the plunger is elevated and the lever lifted, and at least one protrusion on the lever or the clip for mechanically forcing the clip out of engagement with the structure when the plunger drops.

18 Claims, 6 Drawing Sheets

FUEL NOZZLE HAVING IMPROVED HOLD-OPEN CLIP

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

This invention relates to a dispensing nozzle of the type used for dispensing liquid fuels such as gasoline and the like. It is particularly directed to a compact, relatively inexpensive, and durable dispensing nozzle having an improved mechanism for latching a manually operated lever in an open position.

Gasoline dispensing nozzles conventionally include a casing having an inlet and an outlet, an outlet spout, and a poppet valve for controlling flow between the inlet and outlet spout. The poppet is urged downwardly against its seat by a spring. A valve stem, which is operated by a manually operated lever or handle, opens the poppet valve against the force of the spring. The plunger of an automatic shut-off assembly forms a pivot for the lever at the forward end of the lever.

The lever is typically S-shaped, including a forward arm pivoted to the plunger of the automatic shut-off means and also engaging the valve stem of the poppet valve, an intermediate portion, and a rearward hand-hold.

In a typical construction, the shut-off assembly also includes latching balls which are mounted in an upper portion of the plunger and are pushed outward by a latch pin against a shoulder in the casing. The latch pin includes a tapered surface which engages the balls. The latch pin is carried on one side of a diaphragm, the other side of which defines a pressure chamber with a cap on the body. A spring in the pressure chamber determines the sensitivity of the mechanism to changes in pressure in the pressure chamber. The latch pin is withdrawn from the plunger in response to submerging the end of the outlet spout in liquid. When the latch pin is withdrawn from the plunger, the balls move inward away from the shoulder; the plunger drops, thereby shifting the pivot point and preventing the lever from lifting the valve stem. This construction is well known in the art and is described in Carder, U.S. Pat. No. 3,757,834, and in Carder et al, U.S. Pat. No. 3,273,609, for example.

The automatic shut-off system of commercially available fuel dispensing nozzles drops the pivot point of the manual lever sufficiently to disable the lever from opening the nozzle's valve regardless of the position of the lever. Therefore, the lever may be held by a clip of some sort, to relieve the operator from holding the lever while a fuel tank is being filled. It has been recognized as desirable that the clip be simple, that it hold the lever securely, that it retract automatically when the automatic shut-off operates, so that the lever returns to its rest position, that it not obstruct the lever or the hand of the user in normal operation, and that it be operable with the same hand that is operating the lever. It is also desirable for the clip to be durable and relatively immune to environmental interference such as ice. The clip should also not protrude from the nozzle body or interfere with positioning the nozzle in a fuel tank or on a pump rack.

Various clips have been provided in the past, but none has met all of the foregoing criteria.

A particularly popular clip is shown in, for example, Lasater, et al, U.S. Pat. No. 3,823,752. This clip is rotatably mounted to the manual lever and engages a toothed ratchet plate on the hand guard to hold the lever in a raised position. A spring, not shown in the Lasater patent, is mounted between the lever and clip to bias the clip up and out of contact with the ratchet plate. The spring is conventionally a coil spring with extended ends or else a leaf spring, although the type of spring is not essential to the operation of the clip. This type of clip releases when downward and rearward movement of the forward end of the lever causes a momentary release of the engagement between the clip and the latch plate, and the clip's spring pushes the clip up and out of engagement with the ratchet plate. This type of clip can become unreliable with use. By way of example, the ratchet plate may become worn, with resulting slippage or deeper engagement of the clip into the teeth of the plate, or the hand guard, which is frequently made of molded plastic and held by bolts to cast body of the nozzle, becomes somewhat loose, thereby spacing the ratchet plate farther from the clip and changing the geometry of the mechanism. Under these circumstances, and others, the clip may not retract when the nozzle shuts off, leaving the lever hand-hold locked in its elevated position.

Other similar approaches are shown, for example, in Carder et al, U.S. Pat. No. 3,273,609, Tamra, U.S. Pat. No. 4,593,729, and Fink, U.S. Pat. No. 6,585,014, in which the ratchet plate is held by the lever. These approaches are expected to have similar problems.

Carder et al, U.S. Pat. No. 5,067,533 attempts to solve the problem by mounting the clip on a cast hand guard and using a cast lever having a unique shape that forces the clip open when the automatic shut-off mechanism drops the front end of the lever. This arrangement is somewhat complex and costly.

BRIEF SUMMARY OF THE INVENTION

Briefly stated, the present invention provides an automatic shut-off nozzle having an operating lever-clip assembly, including a lever part and a clip part. The lever is pivoted at its forward end to a plunger, and the clip is pivoted to the lever, the clip selectively engaging a holding tooth and holding the lever open when the plunger is elevated and the lever lifted. At least one structure is provided on the lever-clip assembly which forces the clip out of engagement with the tooth when the plunger drops. As used herein, the term "tooth" includes any surface that holds an end of the clip, whether that surface extends above or below a surrounding surface.

Preferably, the clip is formed with a U-shaped cross section embracing the lever, and a protrusion extends inwardly from one leg of the clip. When the clip is engaged by the tooth and the front of the lever moves downward and rearward in response to release of the automatic shut-off, the protrusion is engaged by the lever and forces the clip out of engagement with the holding structure. In other embodiments, the structure which forces the clip out of engagement with the tooth is an outwardly extending protrusion on the lever, and in still other embodiments the structure is a separate piece.

In a preferred embodiment, the clip is held by a ratchet tooth on a handguard of the nozzle.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
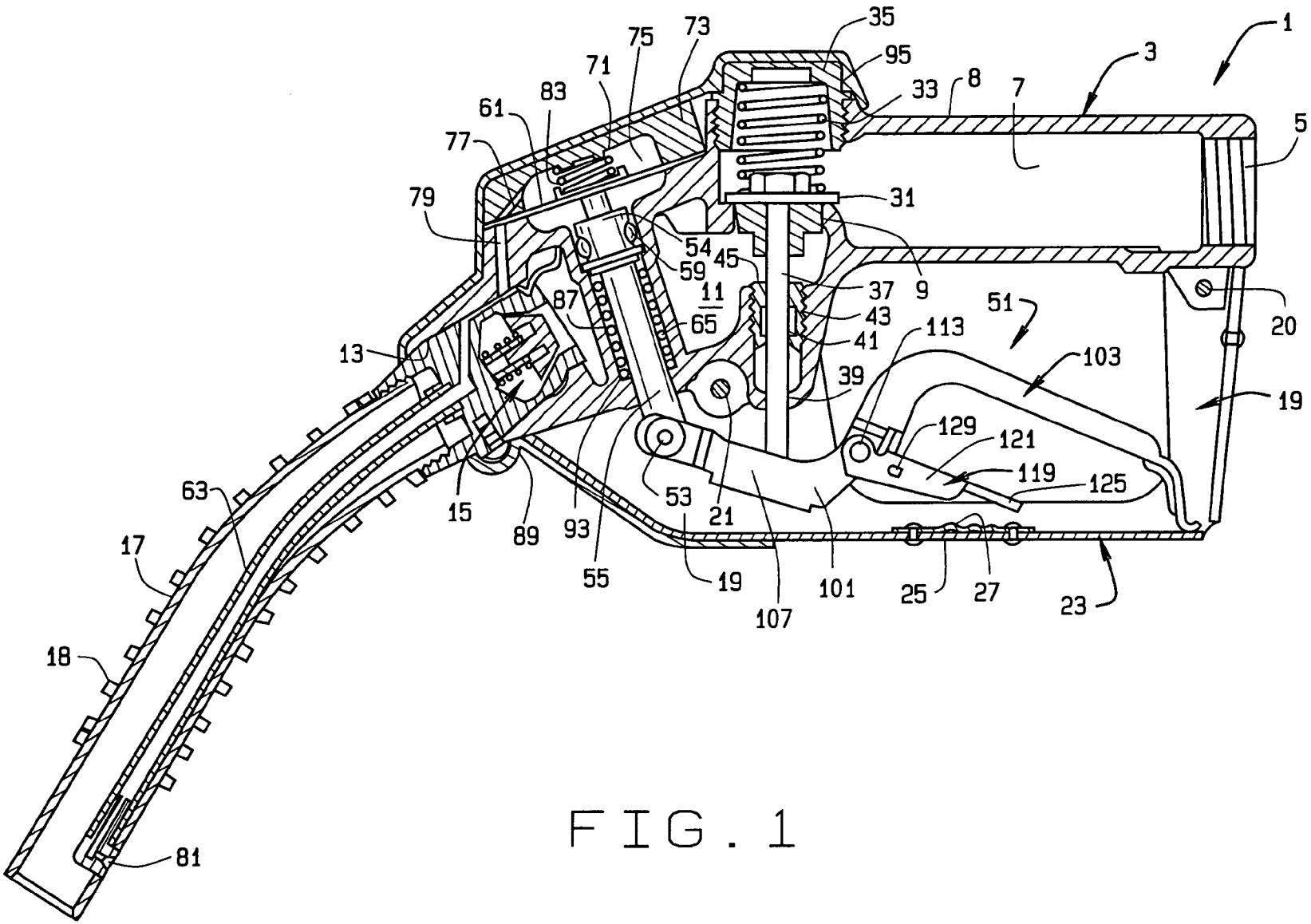
FIG. 1 is a sectional view in side elevation of an illustrative nozzle incorporating a lever and clip in accordance with one embodiment of the present invention.
Figure 2:
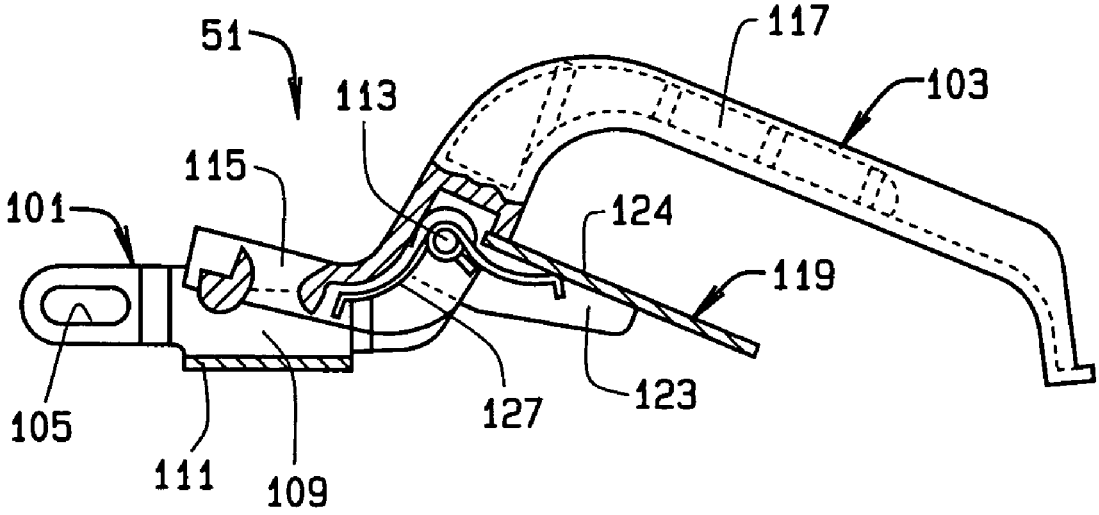
FIG. 2 is a sectional view of the lever and clip of FIG. 1.

Referring now to the drawings, and in particular to FIGS. 1 and 2, reference numeral 1 indicates one illustrative embodiment of gasoline dispensing nozzle incorporating my invention. The nozzle 1 is similar in construction and operation to the nozzle shown and described in the previously mentioned Lasater et al, U.S. Pat. No. 3,823,752, a type of nozzle known in the art as a "type 1A" nozzle. The details of the nozzle are well known and do not, per se, form a part of the present invention.

Briefly, the nozzle 1 includes a cast body 3, preferably formed of aluminum. It has a passage through it including an inlet 5, a generally cylindrical inlet chamber 7, a valve seat 9, an outlet chamber 11 downstream of the valve seat 9, and an outlet 13. Inlet 5 is threaded to receive a flexible hose from a gasoline pump. The portion of the body forming the inlet chamber 7 forms a hand-hold 8 for the nozzle. Outlet 13 receives a conventional venturi/check valve assembly 15 and a spout 17, including a spring 18, adapted to be inserted into the fill tube of a vehicle fuel tank.

A hand guard 19 is held by screws 20 and 21 to the cast body 3. The hand guard 19 is formed of molded plastic and includes a horizontal lower portion 23. The lower portion 23 is shallowly U-shaped in cross-section. A ratchet plate 25 having teeth 27 is mounted on the upper surface of the lower portion 23.

Most of the inner parts of the nozzle are standard. A main poppet valve assembly 31 is urged by a poppet spring 33 against the valve seat 9 to close the passage through the casing 3. The poppet spring 33 is held in a casing cap 35 threaded into the top of the casing 3. A stem 37 extending from the lower end of the valve 31 is slidably mounted in the casing 3. The lower portion of the stem 37 passes through the casing 3, through a sliding seal consisting of packing 39, held by a packing gland 41, held by a packing spring 43, held by a packing nut 45 threaded into the casing 3. The valve assembly is preferably that disclosed in commonly assigned U.S. Pat. No. 4,487,238, the disclosure of which is incorporated herein by reference.

A standard lever 51 is provided for manually engaging the valve stem 37 and lifting the valve assembly 31 from the valve seat 9. The lever is S-shaped, with a generally horizontal lower lever part, an intermediate part, and an upper hand-hold part. A clip is pivoted to the lever. The lever and clip are described in more detail hereinafter.

The forward end of the lever 51 is held by a pivot pin 53 to the lower end of a cylindrical plunger 55 which is mounted for reciprocation in the casing 3 as described in more detail hereinafter. The plunger 55 forms a part of an automatic shut-off system for shutting off the flow of gasoline through the nozzle when the level of gasoline in the tank being filled reaches the end of the spout. The shut-off system includes the plunger 55, a latch pin 57, three latching balls 59, a diaphragm 61, the venturi 15, and a breather tube 63. A coil plunger spring 65 biases the plunger 55 upward. The latch pin 57 extends into a blind axial bore in the upper end of the plunger 55. Three radial openings extending from the outer surface of the cylindrical plunger 55 into the axial bore act as guideways for the latching balls 59. The latch pin 57 is preferably of the form shown in commonly assigned U.S. Pat. No. 3,757,834, the disclosure of which is hereby incorporated. The upper end of the latch pin 57 is secured to the center of the diaphragm 61. The periphery of the diaphragm 61 is secured to a shoulder 71 of the casing 3 by a threaded vacuum cap 73 and defines with the vacuum cap 73 a pressure chamber 75 in the casing. The vacuum cap 73 may be identical with the casing cap 35. In addition to the usual threads, the cap 73 includes at least one slot 77 for creating a continuous passage between the pressure chamber 75 and a vacuum passage 79 in the casing. The vacuum passage 79 communicates with the venturi 15, which in turn communicates with a fitting 81 at the downstream end of the spout through the breather tube 63. A balance spring 83 on the upper side of the diaphragm 61 positions the latch pin 57 and determines the sensitivity of the automatic shut-off system.

The portion of the body 3 forming the housing for the shut-off system includes an upstanding generally cylindrical wall 87 forming a housing for the plunger 55. The inner surface of the wall 87 is stepped to form a balance chamber, a chamber for balls 59, and a chamber for spring 65. A ring 91 is beveled inwardly, to form a seat for the balls 59. A wall 93 at the bottom of wall 87 acts as a guide for plunger 55 where it exits the cast body 3 and as a bearing for plunger return spring 65.

If desired a scuff guard 95 may be placed over parts of the nozzle 1.

As described thus far, the nozzle is conventional.

In the first illustrative embodiment of the present invention, the lever is also conventional. The basic structure and operation of current commercial versions of the lever and clip are described in Carmack, U.S. Pat. No. 6,698,471 and Carow, U.S. Pat. No. 5,832,970. Their theory of operation, and a slightly older version of them, is disclosed in Wilder et al, U.S. Pat. No. 3,817,285 and Boudot et al, U.S. Pat. No. 3,635,415. As disclosed in these patents, the lever consists of a lower lever part 101, which has remained substantially unchanged from the construction disclosed in the foregoing Boudot et al patent, and an upper lever part 103, which as shown in the foregoing Carmack and Carow patents is now commercially made of a plastic material such as glass-reinforced nylon or high density polyethylene.

The lower lever part 101 is formed with upstanding side walls 107 and 109 and a web 111. The forward ends of the walls 107 and 109 of the lower lever part 101 are slotted as shown at 105 to allow the lower lever part to pivot and slide around pivot pin 53 through the bottom of plunger 55.

The upper lever part 103, which forms a handle, is held to the lower lever part by a second pivot pin 113. The upper lever part 103 includes a forward part 115 which may pivot into contact with the web 111 of the lower lever part 101 between the side walls 107 and 109. The forward part 115 includes an opening for the valve stem 37. The rearward part 117 of the upper lever part forms a handgrip for manually lifting the lever.

Figure 11:
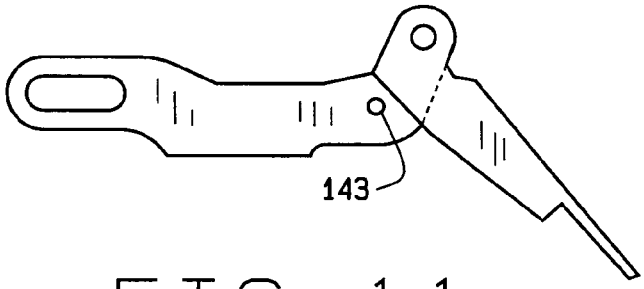
Figure 11A:
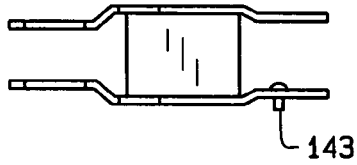
Figure 12:
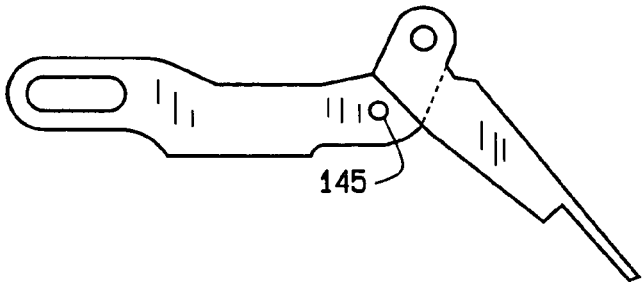
Figure 12A:
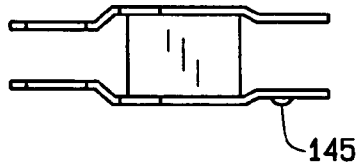
Figure 13:
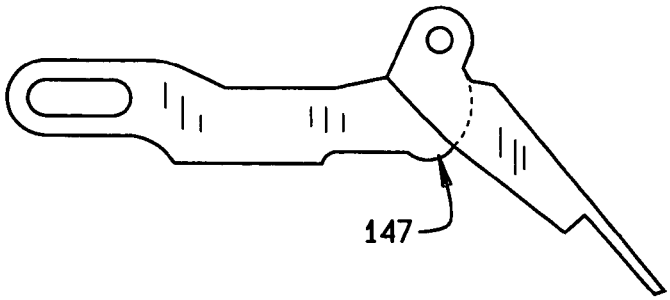

Also pivoted to the second pivot pin 113 is a hold-open clip 119. The clip 119 includes side walls 121 and 123 which embrace the side walls 107 and 109 of the lower lever part, and a web part 124, having a tail 125. A spring 127 biases the clip rearward and upward around the pivot pin 113. The tail 125 of the web part 124 is sized to engage one of the teeth 27 of the ratchet plate 25 to hold the poppet valve 31 open and permit a desired flow rate through the nozzle. In most instances, the lever is lifted to its uppermost travel, and the clip 119 is manually pivoted downward by the user until it engages the forward tooth of the ratchet plate, as shown in FIG. 11 of the Boudot et al patent. As shown in FIGS. 11-13 of the Boudot et al patent, upon release of the plunger 55, the clip 119 no longer has sufficient force applied to generate sufficient friction to overcome the force of spring 127, and the end of the clip is pushed from tooth 27 by the spring 127.

As described thus far, the lever and clip are conventional and well known in the art.

Figure 3:
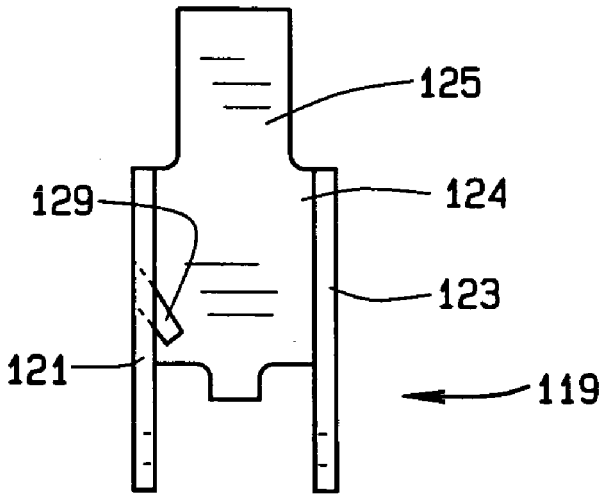
FIG. 3 is a lower plan view of the clip of FIGS. 1-2.

In prior art constructions, the clip 119 sometimes does not break loose from the ratchet plate 25. This may be because of changes in geometry caused by wear on the hand guard, the clip, and the ratchet plate, because of loss of sufficient torsion in the spring 127, because of variations in the as-manufactured dimensions of the hand guard, the lever/clip assembly, or the ratchet plate, because of the use of different fasteners (such as rivets) for holding the hand guard to the cast body, or for other reasons. Whatever the reasons, the failure of the clip 119 to open is both annoying and potentially dangerous. To overcome this problem, the clip 119 in accordance with the present invention is provided with an inwardly turned tab 129 on one of its side walls 121 and 123. As shown particularly in FIGS. 1 and 3, the tab 129 is sized and positioned to be struck by a corresponding side wall 107 or 109 of the lower lever part as the plunger 55 drops. The tab 129 therefore mechanically forces the clip 119 away from the teeth of the ratchet plate. Thus, even should the spring 127 be disabled or broken, the proper operation of the clip 119 is assured.

It will be appreciated that other ways to produce mechanical interference between the lever and the clip are equally useable for the purpose of mechanically forcing the clip away from the ratchet teeth. Several examples are illustrated in FIGS. 4-15.

Figure 4:
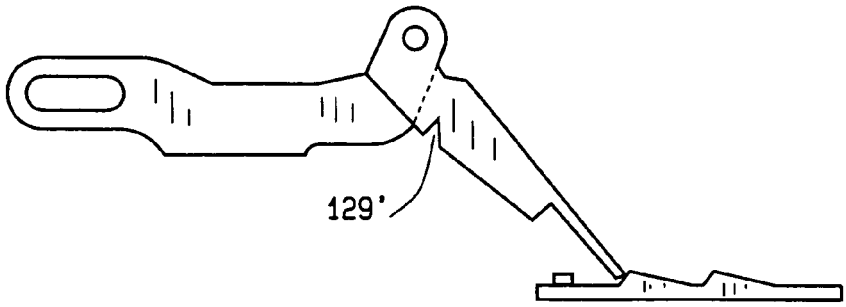
FIGS. 4-15 are fragmentary views of other embodiments of illustrative clips and levers in accordance with the present invention.
Figure 4A:
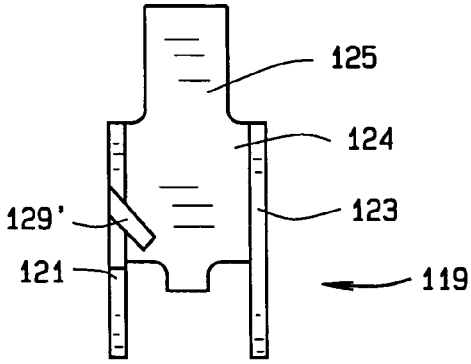
Figure 5A:
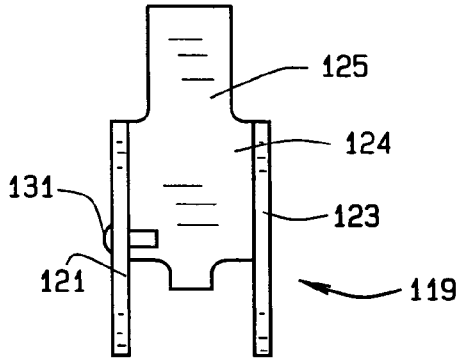
Figure 5:
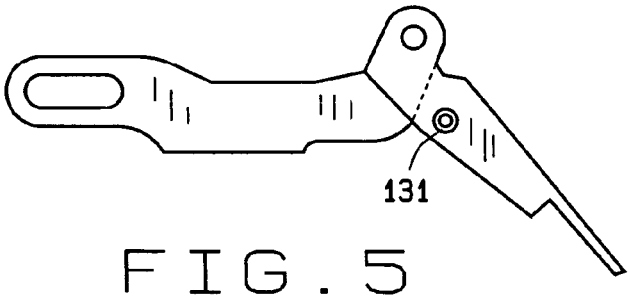
Figure 6A:
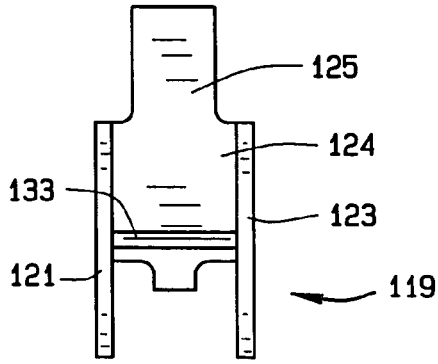
Figure 6:
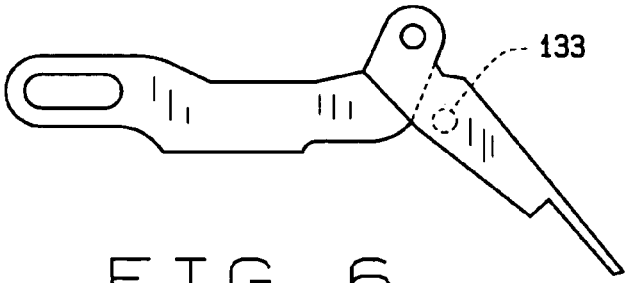
Figure 7:
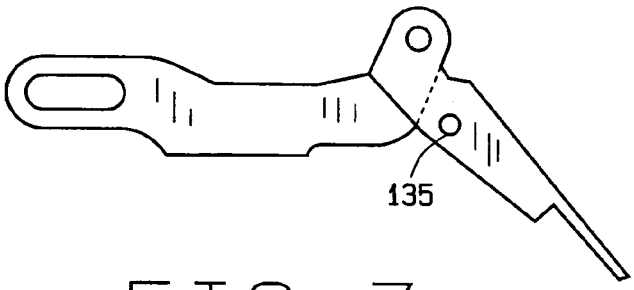
Figure 7A:
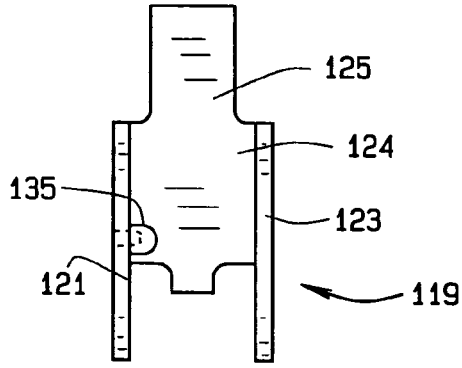
Figure 8:
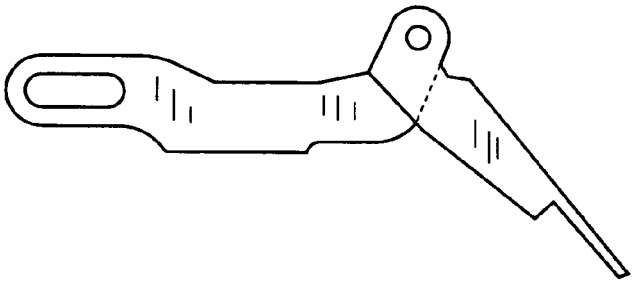
Figure 8A:
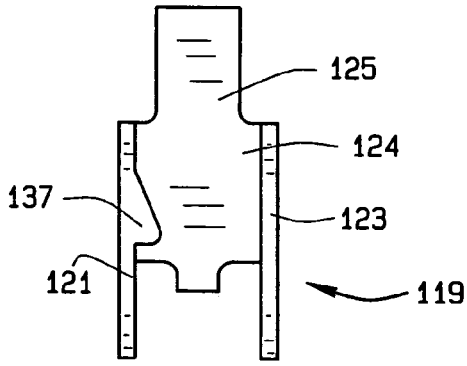

The clip may be given an inwardly extending part positioned to be struck by the lever. As shown in FIGS. 4 and 4A, the tab 129' may be bent inward from an edge of the clip. As shown in FIGS. 5 and 5A, a separate rivet 131 may be attached through an opening in a side wall of the clip. As shown in FIGS. 6 and 6A, a bar 133 may be spot welded between the side walls of the clip. As shown in FIGS. 7 and 7A, a dimple 135 may be struck inwardly in one side wall of the clip. As shown in FIGS. 8 and 8A, a side wall of the clip may be given a shape having an inturned lip 137 positioned to be struck when the forward end of the lever drops. The inwardly extending part in any of the foregoing embodiments may be provided on either side wall or both.

Figure 9:
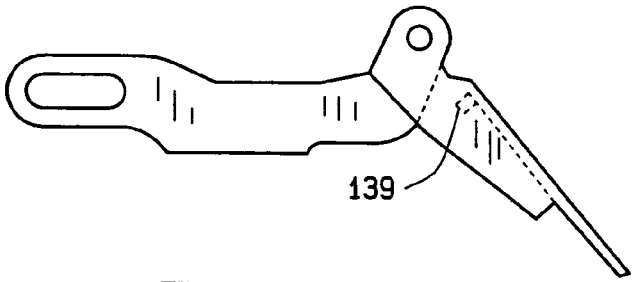
Figure 9A:
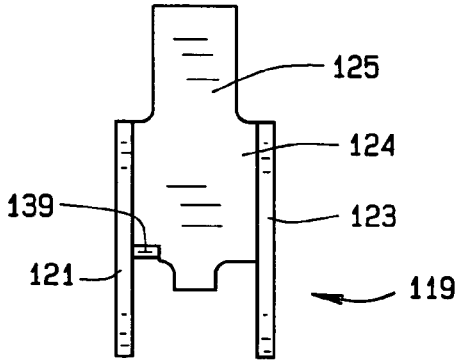

The clip may also be modified in other ways to provide a part which mechanically strikes the lower lever part 101 to force the clip to release. For example, a tab 139 may be bent down from the forward end of the web 124 of the clip as shown in FIGS. 9 and 9A.

Figure 10:
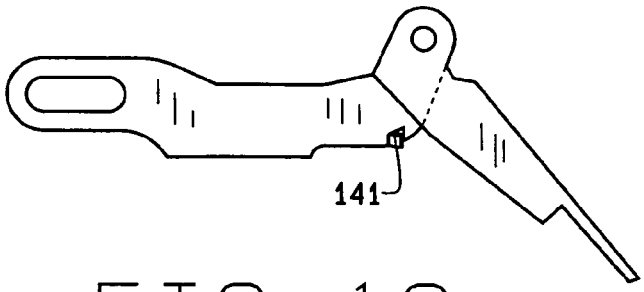
Figure 10A:
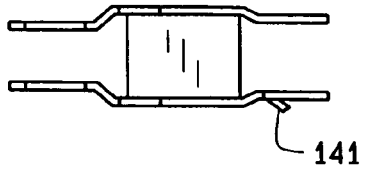

Likewise, the lever may be given an outwardly extending part positioned to strike the clip. As shown in FIGS. 10 and 10A, a tab 141 may be bent out in a position to strike the clip and force the clip out of a tooth 27 of the ratchet plate. As shown in FIGS. 11 and 11A and FIGS. 12 and 12A, a rivet 143 or a dimple 145 may extend outwardly from the lower lever part 101.

As shown in FIG. 13, the lower lever part 103 may be formed with an enlarged lip 147 extending to engage the web 124 of the clip when the plunger 55 drops.

Figure 14:
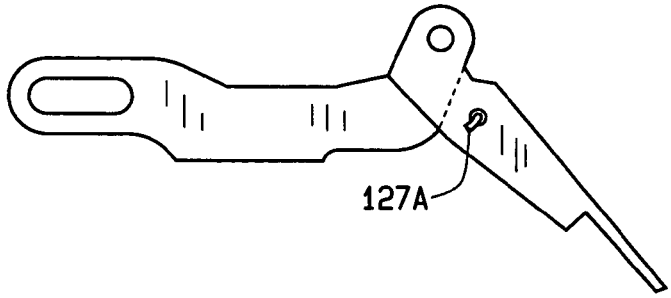
Figure 15:
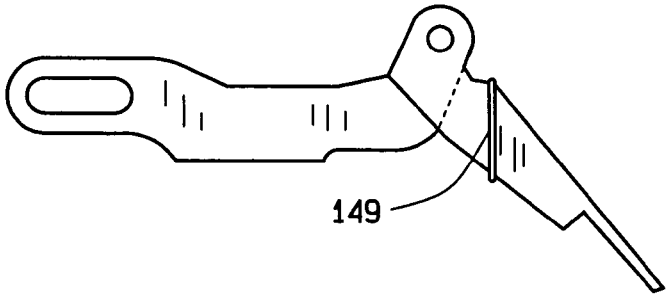
Figure 15A:
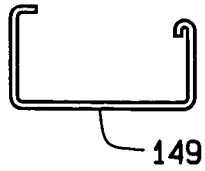

A separate part may also produce the mechanical engagement to force the clip away from the ratchet plate. For example, as shown in FIG. 14, one end of spring 127A may be brought through an opening in a side wall of the clip 119. The web of a separate U-shaped spring 149 may be extended between the lower edges of side walls 121 and 123 of the clip 119, and the spring 149 snapped over the upper edges of the clip 119 as shown in FIG. 15. An additional part mounted on the pivot pin 113 could also engage the clip when the plunger 55 drops.

Numerous other variations in the hold-open device of the present invention, within the scope of the appended claims, will occur to those skilled in the art. Merely by way of example, analogous modifications may be made to the lever or clip of the previously mentioned Carder et al, U.S. Pat. No. 3,273,609, Tamra, U.S. Pat. No. 4,593,729, and Fink, U.S. Pat. No. 6,585,014, in which the ratchet plate is held by the lever. If either the lower lever part or the clip is cast or molded, rather than being formed of sheet material, the mechanically interfering parts may be molded or cast directly in the parts. These variations are merely illustrative.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

All patents mentioned herein are hereby incorporated by reference.

The invention claimed is:

1. An automatic shut-off nozzle having an operating lever-clip assembly, the assembly including a lever and a clip, the lever being pivoted at its forward end to a plunger, the plunger being moveable between an elevated position and a dropped position, the clip being pivoted to the lever, the clip selectively engaging a holding tooth and holding the lever open when the plunger is elevated and the lever lifted; a spring urging the clip rearwardly and upwardly relative to the lever; and at least one structure on the lever-clip assembly which produces mechanical interference between the lever and the clip and forces the clip out of engagement with the tooth when the plunger moves from its elevated position to its dropped position.

2. The nozzle of claim 1 wherein the clip is formed with a U-shaped cross section embracing the lever, the structure comprising a protrusion extending inwardly from one leg of the clip.

3. The nozzle of claim 2 wherein the protrusion is formed integrally with the clip.

4. The nozzle of claim 2 wherein the protrusion is a tab struck from a side wall of the clip.

5. The nozzle of claim 1 wherein the structure comprises a protrusion extending outwardly from the lever.

6. The nozzle of claim 5 wherein the protrusion is formed integrally with the lever.

7. The nozzle of claim 6 wherein the protrusion is a tab struck from a side wall of the lever.

8. The nozzle of claim 1 wherein the structure comprises an end of the spring extending between the lever and the clip.

9. The nozzle of claim 1 wherein the structure is a piece formed separately from the lever and clip.

10. The nozzle of claim 1 wherein the plunger is a part of an automatic shut-off, the plunger moving downward and rearward in response to release of the automatic shut-off.

11. The nozzle of claim 1 wherein the nozzle comprises a casting and a hand guard attached to the casting, the holding tooth comprising one of a plurality of ratchet teeth on the hand guard.

12. The nozzle of claim 11 comprising a ratchet plate secured to the hand guard, the ratchet teeth being provided on the ratchet plate.

13. The nozzle of claim 1 wherein the lever comprises a lower lever part pivoted to the plunger and engaging a valve stem, and an upper lever part pivoted to the lower lever part.

14. The nozzle of claim 13 wherein the clip is pivoted to the lever along a common axis with the pivot between the upper lever part and the lower lever part.

15. The nozzle of claim 1 wherein the clip comprises upstanding walls connected by a web and wherein the structure is sized and positioned to engage the web when the plunger moves to its dropped position.

16. The nozzle of claim 15 wherein the structure is formed on the lever.

17. The assembly of claim 14 wherein the lower lever part includes a generally horizontal web part, the structure limiting movement of the clip to positions angled greater than 90° from the web part.

18. The assembly of claim 17 wherein the structure is formed integrally with the clip or with the lower lever part.

* * * * *